US010595599B2

(12) United States Patent
Cucchiara et al.

(10) Patent No.: US 10,595,599 B2
(45) Date of Patent: Mar. 24, 2020

(54) DIRECT PRINTED JEWELRY CHARM

(71) Applicants: Daniel Cucchiara, Orlando, FL (US); Burnice LeAnn Cucchiara, Orlando, FL (US)

(72) Inventors: Daniel Cucchiara, Orlando, FL (US); Burnice LeAnn Cucchiara, Orlando, FL (US)

(73) Assignee: Danglz LLC, Orlando, FL (US)

( * ) Notice: Subject to any disclaimer, the term of this patent is extended or adjusted under 35 U.S.C. 154(b) by 0 days.

(21) Appl. No.: 16/004,034

(22) Filed: Jun. 8, 2018

(65) Prior Publication Data

US 2018/0352919 A1 Dec. 13, 2018

Related U.S. Application Data

(60) Provisional application No. 62/518,869, filed on Jun. 13, 2017.

(51) Int. Cl.
*A44C 25/00* (2006.01)
*A44C 27/00* (2006.01)

(52) U.S. Cl.
CPC ..... *A44C 25/007* (2013.01); *A44C 27/001* (2013.01)

(58) Field of Classification Search
CPC ... A44C 25/007; A44C 27/001; A44C 25/001; A44C 25/002; A44C 25/005; A44C 3/007; A44C 27/00; Y10T 29/49588; Y10T 29/4959
USPC ..... 63/18, 19, 23, 21
See application file for complete search history.

(56) References Cited

U.S. PATENT DOCUMENTS 2,450,620 A * 10/1948 Speicher ..... A44C 17/006 63/18
4,582,447 A * 4/1986 Itoh ..... A63H 33/108 403/305
4,947,527 A * 8/1990 Hennig ..... A63H 17/264 24/586.11
5,157,945 A * 10/1992 Giehl ..... A44C 3/00 63/23
6,739,935 B2 * 5/2004 Van Teunenbroek ..... A63H 37/00 273/451
8,769,986 B1 7/2014 DiPietro
8,955,356 B1 2/2015 Smith
2011/0232064 A1 9/2011 Boyd
2015/0082831 A1 * 3/2015 Ellman ..... A44C 13/00 63/1.13
2015/0089975 A1 * 4/2015 Paleschuck ..... G09F 23/00 63/1.13
2015/0173471 A1 6/2015 Weems et al.
2016/0090199 A1 3/2016 Lasnier et al.
(Continued)

*Primary Examiner* — Jack W Lavinder
(74) *Attorney, Agent, or Firm* — Jason T. Daniel, Esq.; Daniel Law Offices, P.A.

(57) ABSTRACT

A jewelry charm includes a pair of identical main body sections, each having an inside facing surface, an outside facing surface, a centrally located cylindrical protrusion that is positioned along the inside facing surfaces, a centrally located cylindrical indentation that is positioned along the inside facing surfaces, an elongated indentation that encircles the cylindrical indentation and protrusion, a bonding agent that is positioned between the pair of main body sections, and a connector having a proximal end that is secured between the pair of main body sections and a distal end that is positioned away from the pair of main body sections.

8 Claims, 5 Drawing Sheets

(56) References Cited

U.S. PATENT DOCUMENTS

| | | | | |
|---|---|---|---|---|
| 2016/0249713 | A1* | 9/2016 | Chu Hang | A44C 13/00<br>24/574.1 |
| 2016/0252130 | A1 | 9/2016 | Fathi | |

* cited by examiner

DIRECT PRINTED JEWELRY CHARM

CROSS-REFERENCE TO RELATED APPLICATIONS

This application claims the benefit of U.S. application Ser. No. 62/518,869 filed on Jun. 13, 2017, the contents of which are incorporated herein by reference.

TECHNICAL FIELD

The present invention relates generally to printing devices and items which can be printed upon.

BACKGROUND

The statements in this section merely provide background information related to the present disclosure and may not constitute prior art.

Plastic jewelry charms are typically constructed from large sheets of molded plastic which are cut into a desired shape and have a unitary construction. The charms are then typically covered with an adhesive-backed sheet of material containing some type of decorative element such as various colors, shapes or images, for example. Owing to the high cost of the machinery involved in producing such items, it is not cost effective to produce smaller batches of charms having different and/or user-specified decorative elements displayed thereon.

Owing to recent advancements in ink and printing technology, the inventor has discovered various methods of printing decorative elements directly onto plastic charms of various shapes and sizes utilizing commercially available ink jet printers. To this end, as such printers are only capable of printing along a single plane, it is necessary for the printer to be able to access the front and back sides of a charm simultaneously, in order to impart a custom and/or user-provided decorative element onto the charm.

The present invention, for a direct printed jewelry charm and method of making, differs from the conventional art in a number of aspects. The manner by which will become more apparent in the description which follows, particularly when read in conjunction with the accompanying drawings.

SUMMARY OF THE INVENTION

The present invention is directed to a direct printed jewelry charm. One embodiment of the present invention can include a pair of identically shaped main body sections, each including an inside facing surface and an outside facing surface. Each main body section further including a centrally located protrusion, a centrally located indentation, a continuous channel, a continuous lip, and a T-shaped channel.

Another embodiment of the present invention can include a connector for securing the charm to a piece of jewelry. The connector including a T-shaped member that is connected to a bail via a pivotal coupler.

When the two main body sections are secured together, the continuous lip provides a centrally located gap into which a bonding agent resides. The central protrusions and indentations are configured to engage, and the continuous indentation provides a channel for capturing excess bonding agent.

This summary is provided merely to introduce certain concepts and not to identify key or essential features of the claimed subject matter.

BRIEF DESCRIPTION OF THE DRAWINGS

Presently preferred embodiments are shown in the drawings. It should be appreciated, however, that the invention is not limited to the precise arrangements and instrumentalities shown.

DETAILED DESCRIPTION OF THE INVENTION

Figure 1:
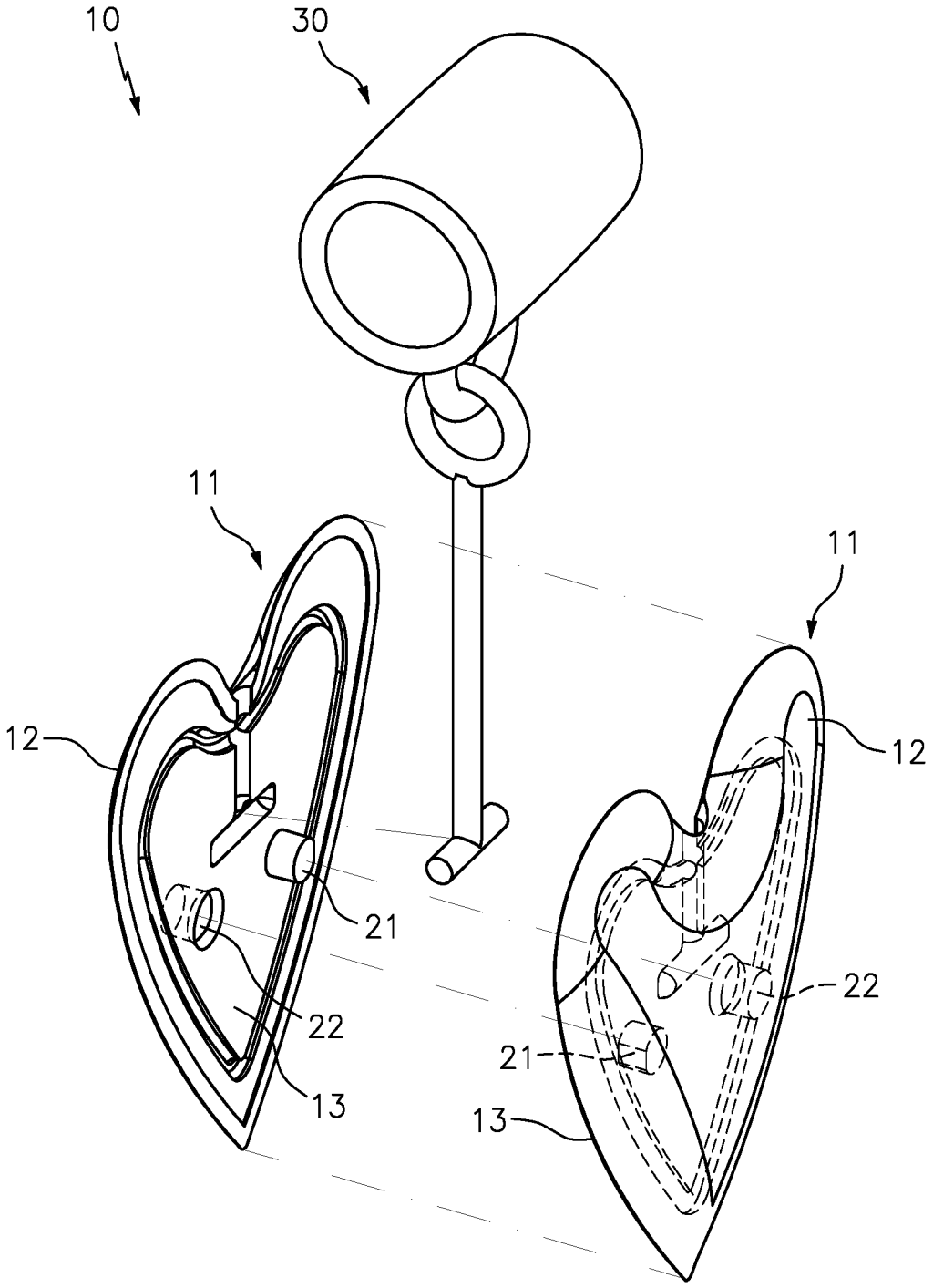
FIG. 1 is an exploded parts view of a direct printed jewelry charm that is useful for understanding the inventive concepts disclosed herein.

While the specification concludes with claims defining the features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention which can be embodied in various forms. Therefore, specific structural and functional details disclosed herein are not to be interpreted as limiting, but merely as a basis for the claims and as a representative basis for teaching one skilled in the art to variously employ the inventive arrangements in virtually any appropriately detailed structure. Further, the terms and phrases used herein are not intended to be limiting but rather to provide an understandable description of the invention.

As described throughout this document, the term "complementary shape," and "complementary dimension," shall be used to describe a shape and size of a component that is identical to, or substantially identical to the shape and size of another identified component.

As described throughout this document, the term "decorative elements" can include any number and type of different colors, markings, words, shapes, symbols, logos, designs, patterns, images, lithographs and/or photographs, for example. These elements can be secured onto and/or into the identified portion of the main body in accordance with known techniques.

FIGS. 1-5 illustrate one embodiment of a direct printed jewelry charm 10 that are useful for understanding the inventive concepts disclosed herein. In each of the drawings, identical reference numerals are used for like elements of the invention or elements of like function. For the sake of clarity, only those reference numerals are shown in the individual figures which are necessary for the description of the respective figure. For purposes of this description, the terms "upper," "bottom," "right," "left," "front," "vertical," "horizontal," and derivatives thereof shall relate to the invention as oriented in FIG. 1.

FIG. 1 is an exploded parts view of the charm 10 that includes, essentially, front and rear main body sections 11, and a connector 30.

As described herein, the pair of main body sections 11 can be constructed from identical pieces of lightweight polymeric materials such as injection molded plastic, for example, and can each include a smooth outside facing surface 12, and an inside facing surface 13.

As will be described below, both main body sections can be joined together to form front and back halves of a single decoratively shaped charm, such as the illustrated heart, for example. Of course, the shape of the charm is not limited to a heart, as any number of other shapes (e.g., oval, triangular, square, polygonal) are also contemplated. Despite each main body section including identical structural elements, it is contemplated that each member can include unique and/or different decorative elements along the outside facing surface. Although the process and methodology of imprinting onto the main body members is outside the scope of the present description, it is contemplated that each of the outside facing surfaces will initially include decorative elements that have been imprinted thereon.

Figure 2:
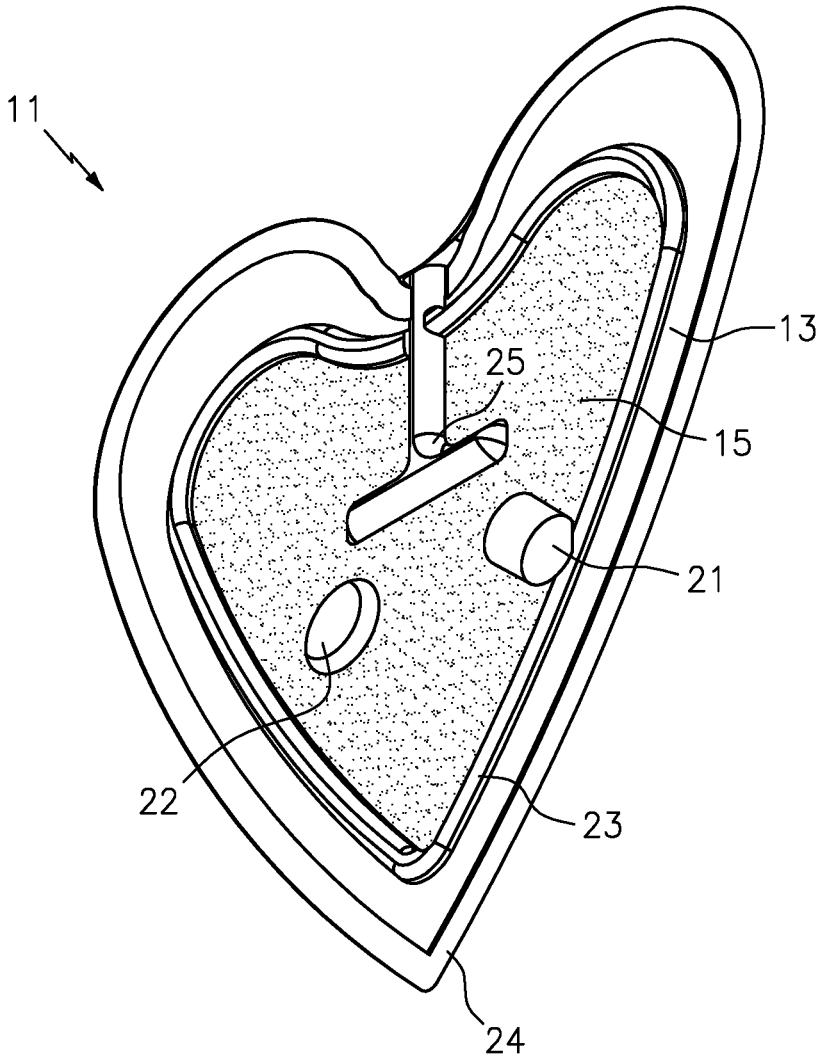
FIG. 2 is a plan view of the inside facing surface of the direct printed jewelry charm, in accordance with one embodiment of the invention.

As shown in FIG. 2, the inside facing surface 13 of each of the main body sections 11 can include a centrally located protrusion 21 and indentation 22. The centrally located protrusion 21 can include a cylindrical shaped member projecting outward from the surface, whereas the indentation 22 can include cylindrical shaped indentation having a complementary dimension to the protrusion. The protrusion and indentation are positioned side by side, and are oriented so as to be engaged by a corresponding indentation and protrusion of the second main body section when forming a finished charm. Such components ensure the two main body sections are properly aligned when joined together.

As will be described below, during assembly of the charm, a measured amount of bonding agent 15 such as glue or resin, for example, can be positioned along a portion or an entirety of the central portion of the inside facing surface 13. Because the outer surface 12 has been imprinted with a decorative element, it is critical to ensure that the bonding agent does not leak from the outer edges of the two halves during assembly and make contact with the finished front surfaces 12. Owing to the chemical makeup of bonding agents, such a situation would ruin the decorative elements that have been printed on the outside surface of the charm.

In order to prevent leakage of the bonding agent, one preferred embodiment includes an elongated continuous indentation 23 that is positioned a first distance from the outer edge of the main body sections 11. The purpose of the indentation 23 is to provide a cavity extending along an entirety of the main body into which any excess bonding agent that would typically escape can be contained.

In one embodiment, the inside surface 13 can include a continuous lip 24 along the outer periphery of the body section. The lip forming a raised edge section that serves two functions. First, the edge provides a centrally located gap between the inside facing surfaces 13 of the two halves when the finished charm is being assembled. This gap reduces the force applied onto the bonding agent located therein, that would typically cause the agent to be expelled from the assembly. Second, the lip acts as a secondary boundary to ensure that any bonding agent that is not trapped by the indentation 23 is unable escape.

In one embodiment, a generally inverted T-shaped indentation 25 can be positioned along the top end of each of the main body section 11. The indentation can function to receive the generally T-shaped connection element of the below described connector 30. As such, each of the indentations 25 can include a depth that is approximately ½ the thickness of the T-shaped connection element they are to receive.

Figure 3:
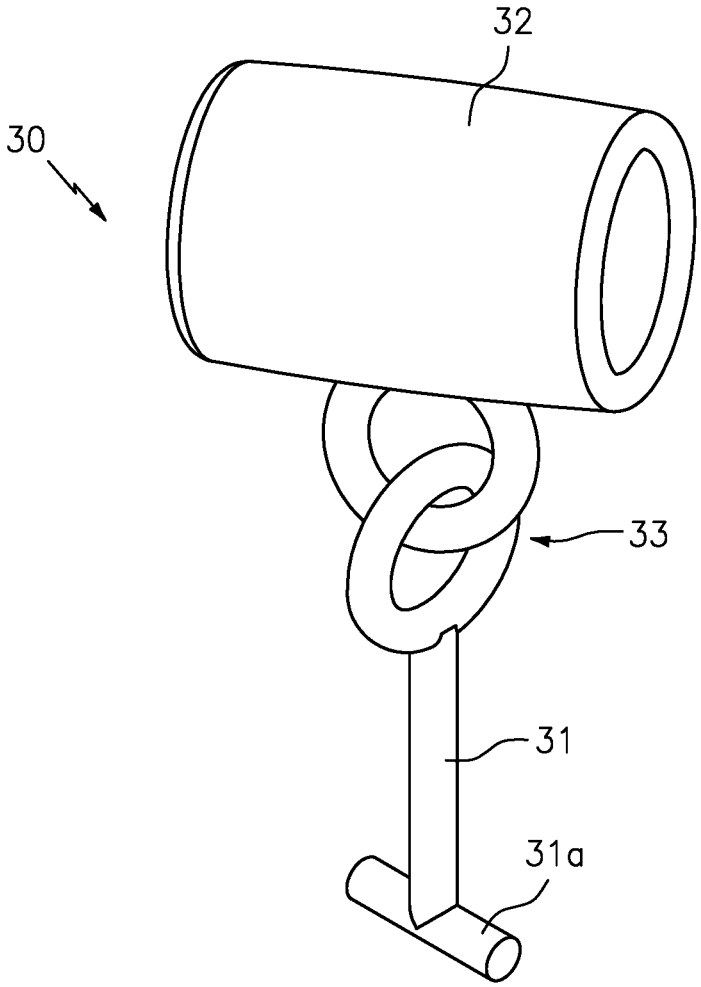
FIG. 3 is a perspective view of the connector of the direct printed jewelry charm, in accordance with one embodiment of the invention.

FIG. 3 illustrates one embodiment of a connector 30 that can function to secure the assembled charm 10 to a secondary object, such as a bracelet or necklace, for example. As shown, the connector can preferably include a generally T-shaped member 31 that is constructed from a lightweight, rigid material such as metal, for example. The T-shaped member is connected to a bail 32 by virtue of an articulating joint 33. The articulating joint 33 is appreciated to be any conventional mechanism known to the art, such as the illustrated clasp and ring assembly, for example, that allows both components 31 and 32 to rotate and/or pivot about the other.

As noted above, the proximal end 31*a* of the T-shaped member can be positioned between the T-shaped slots 25 during assembly of the finished charm. By providing structure along two axis, the inclusion of the T-shaped member advantageously ensures the bail will not become separated from the charm.

Figure 4:
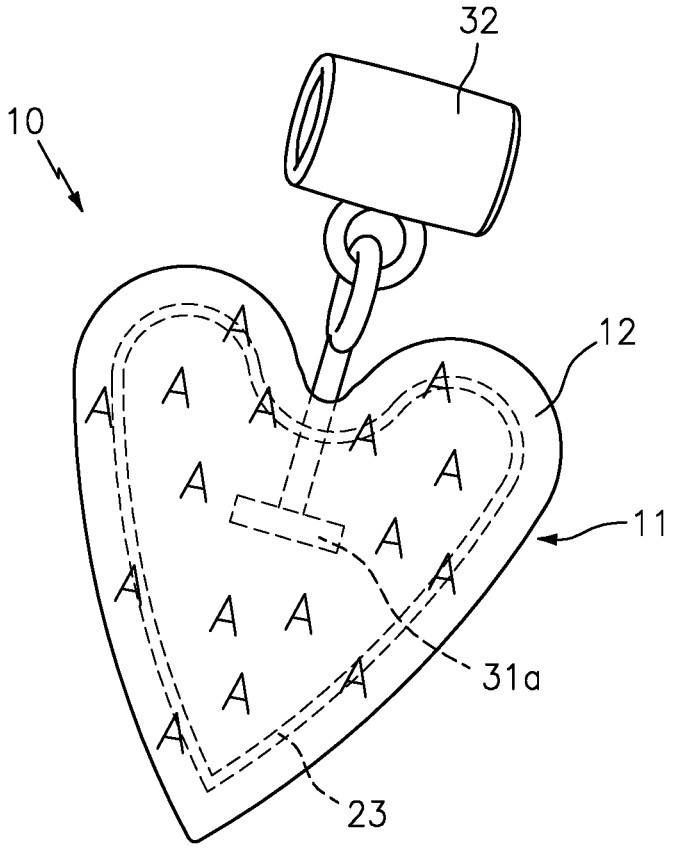
FIG. 4 is a perspective view of an assembled direct printed jewelry charm, in accordance with one embodiment of the invention.

FIG. 4 illustrates one embodiment of a fully assembled charm 10. As shown, the two main body sections 11 are joined to form front and rear facing halves of the charm, and the outside facing portions 12 include custom decorative elements A that are imprinted thereon.

As noted above, it is important that the inside facing surface of each main body section include a continuous indentation 23 and lip 24 to ensure no bonding agent is released when the two halves are pressed together. To this end, the indentation 23 can preferably be spaced 0.070 inches from the outer edge of the main body and can include a depth of 0.019 inches forming a channel having a total depth of 0.14 inches for capturing excess bonding agent.

Likewise, it is preferred that the lip 24 includes a width of 0.030 inches and a height of 0.003 inches, thus resulting in the centrally located gap having an overall depth of 0.006 inches for the bonding agent to be located. Of course, any number of other dimensions are also contemplated.

Figure 5:
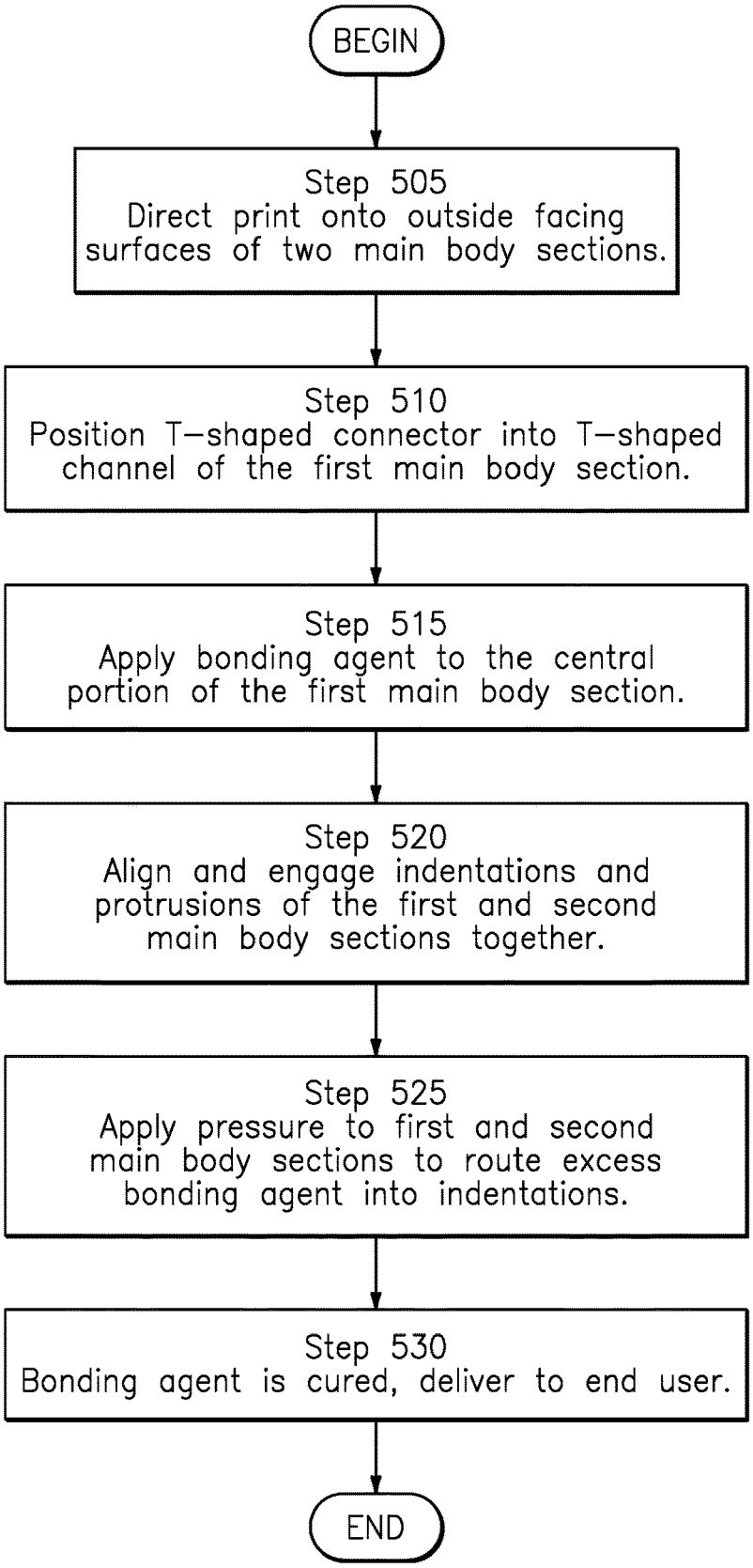
FIG. 5 is a simplified block diagram of a method of making a direct printed jewelry charm, in accordance with one embodiment of the invention.

FIG. 5 is a flow chart illustrating a method 500 of making a direct printed jewelry charm, as described above.

The method can begin at step 505 in which a user can print decorative elements onto the outside facing surfaces of two main body sections. As described herein, the decorative elements can preferably be provided by an end user and can include items such as a photograph, for example. In either instance, once the decorative elements have been imprinted onto the main body sections, the method can proceed to the next step.

In step 510, the proximal end of a T-connector can be positioned within the T-shaped channel of one of the main body sections, and a bonding agent can be applied at step 515.

At step 520, a user can align the complementary indentations and protrusions of the pair of main body sections and can secure the two halves together. Next, the user can apply pressure at step 525 to both halves for a predetermined period of time. During this step, the bonding agent can spread between the inside facing surfaces of the two main body sections and can fill the gap created by the lip sections. Moreover, at this step, any excess bonding agent can be channeled into the continuous indentation and remain there until hardening.

Finally, at step 530, the bonding agent has cured, and the charm is ready for delivery to an end user.

As to a further description of the manner and use of the present invention, the same should be apparent from the above description. Accordingly, no further discussion relating to the manner of usage and operation will be provided.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Likewise, the terms "consisting" shall be used to describe only those components identified. In each instance where a device comprises certain elements, it will inherently consist of each of those identified elements as well.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The invention claimed is:

1. A jewelry charm, comprising:

a first main body section having an inside facing surface and an outside facing surface;

a cylindrical protrusion that is positioned along a central portion of the inside facing surface;

a cylindrical indentation that is positioned adjacent to the cylindrical protrusion, said indentation and protrusion including complementary dimensions;

an elongated indentation that is positioned along the inside facing surface, said elongated indentation encircling the cylindrical indentation and cylindrical protrusion;

a connector having a proximal end that is in communication with the inside facing surface; and a second main body section that is identical to the first main body section and is configured to be removably secured to the first main body section.

2. The jewelry charm of claim 1, wherein the first and second main body sections are configured to be secured together via the cylindrical protrusion and cylindrical indentations located on the inside facing surface of the first and second main body sections.

3. The jewelry charm of claim 1, further comprising:

a bonding agent that is positioned along the central portion of the first main body section at a location between the cylindrical protrusion and the elongated indentation.

4. The jewelry charm of claim 1, wherein the connector comprises:

a T-shaped member having a broad proximal end and a narrow distal end;

a bail that is configured to engage a secondary object; and an articulating joint that is interposed between the distal end of the T-shaped member and the bail.

5. The jewelry charm of claim 4, wherein the bail is constructed from metal.

6. The jewelry charm of claim 4, further comprising:

a first generally T-shaped indentation that is positioned along the inside facing surface of the first main body section; and a second T-shaped indentation that is positioned along the inside facing surface of the second main body section, said first and second T-shaped indentations including a shape and dimension that is complementary to a shape and dimension of the proximal end of the T-shaped member.

7. The jewelry charm of claim 1, wherein the outside facing surface of each of the first and second main body sections includes decorative elements that have been directly printed thereon.

8. A method of making a jewelry charm, said method comprising:

providing a first main body section having an inside facing surface and an outside facing surface;

providing a cylindrical protrusion along a central portion of the inside facing surface;

providing a cylindrical indentation that is positioned adjacent to the cylindrical protrusion, said indentation and protrusion including complementary dimensions;

providing an elongated indentation that is positioned along the inside facing surface, said elongated indentation encircling the cylindrical indentation and cylindrical protrusion;

providing a connector having a proximal end that is in communication with the inside facing surface;

providing a second main body section that is identical to the first main body section;

inserting a proximal end of a T-shaped connector into a T-shaped indentation of one of the main body sections;

applying a bonding agent to a central portion of one of the main body sections;

aligning the cylindrical protrusion of the first main body section with the cylindrical indentation of the second main body section;

pressing the first and second main body sections together; and capturing a portion of the bonding agent within the elongated indentation located along both the first and second main body sections, and waiting for the bonding agent to cure.

* * * * *